US005460540A

United States Patent [19]

Reichle

[11] Patent Number: 5,460,540

[45] Date of Patent: Oct. 24, 1995

[54] ANTI-KINK APPARATUS FOR CABLE PLUGS, IN PARTICULAR FOR COMPUTER SYSTEMS AND THE LIKE

[75] Inventor: Hans Reichle, Wetzikon, Switzerland

[73] Assignee: Reichle+De-Massari AG, Wetzikon, Switzerland

[21] Appl. No.: 162,316

[22] Filed: Dec. 7, 1993

[30] Foreign Application Priority Data

Dec. 23, 1992 [CH] Switzerland ..... 03919/92

[51] Int. Cl.[6] ..... H01R 4/50

[52] U.S. Cl. ..... 439/445; 439/596

[58] Field of Search ..... 439/445–447

[56] References Cited

U.S. PATENT DOCUMENTS 3,720,906 3/1973 Punako et al. ..... 439/445
4,808,774 2/1989 Crane ..... 439/445 X
5,100,341 3/1992 Czyz et al. ..... 439/447

FOREIGN PATENT DOCUMENTS 2947520 6/1981 Germany ..... 439/445

*Primary Examiner*—David L. Pirlot
*Attorney, Agent, or Firm*—Spencer, Frank & Schneider

[57] ABSTRACT

An anti-kink apparatus for closely surrounding a plug-and-cable assembly includes a housing formed of first and second complemental half shells which are articulated to one another whereby the half shells are pivotal with respect to one another. The half shells have a closed position for entirely closely surrounding the plug-and-cable assembly and an open position in which the half shells are removable from or placeable on the plug-and-cable assembly. The anti-kink apparatus further includes a releasable locking arrangement having a locked position for maintaining the half shells locked in the closed position thereof and an unlocked position for allowing the half shells to be pivoted from the closed position into the open position thereof, whereby the half shells are replaceable and reusable.

5 Claims, 1 Drawing Sheet

ANTI-KINK APPARATUS FOR CABLE PLUGS, IN PARTICULAR FOR COMPUTER SYSTEMS AND THE LIKE

BACKGROUND OF THE INVENTION

The present invention relates to an anti-kink apparatus made from synthetic material for cable plugs for computer systems, in particular, where the cable projecting from the plug is guided through an articulated element which tapers in the direction of the cable and which is elastically bendable towards at least one side owing to recesses provided in the material and which is adjoined by a casing provided for encompassing a part of the plug.

Anti-kink apparatuses of the kind mentioned above in cable plugs are commonly used to prevent cable breakages caused by bending at a too small radius. This is of major importance in cable plugs, in particular, for communications networks such as computer systems where minute plugs with a plurality of extremely thin copper wires or glass fibres ensure the worldwide standardized connection norms for telecommunications and data communications connections.

Anti-kink apparatus of this kind are either molded in with the plug and cable or, after the wiring, placed on the plug from the cable side and interlocked or glued.

In either case the plug becomes unusable after a fault or changes occur in the connection and it has to be exchanged, including the feed line and anti-kink apparatus.

SUMMARY OF THE INVENTION

It is therefore an object of the present invention to provide an anti-kink apparatus of the kind mentioned above which can be applied on-site and which can be removed or exchanged at will.

This is achieved in accordance with the present invention, according to which, briefly stated, the anti-kink apparatus for closely surrounding a plug-and-cable assembly includes a housing formed of first and second complemental half shells which are articulated to one another whereby the half shells are pivotal with respect to one another. The half shells have a closed position for entirely closely surrounding the plug-and-cable assembly and an open position in which the half shells are removable from or placeable on the plug-and-cable assembly. The anti-kink apparatus further includes a releasable locking arrangement having a locked position for maintaining the half shells locked in the closed position thereof and an unlocked position for allowing the half shells to be pivoted from the closed position into the open position thereof, whereby the half shells are replaceable and reusable.

Said measures allow the on-site provision of the plugs in question at will with an anti-kink apparatus which can be exchanged at will for providing them with a coloured connection marking, for example.

To secure easy handling whilst providing secure locking of the two half shells, the arrangement of the subject matter of the invention may preferably be provided in such a way that the closed half shells can be locked by releasable bracket (strap) means.

BRIEF DESCRIPTION OF THE DRAWING

An exemplary embodiment of the subject matter of the invention is explained in greater detail below by reference to the accompanying drawing, wherein.

DETAILED DESCRIPTION OF THE PREFERRED EMBODIMENT

Figure 1:
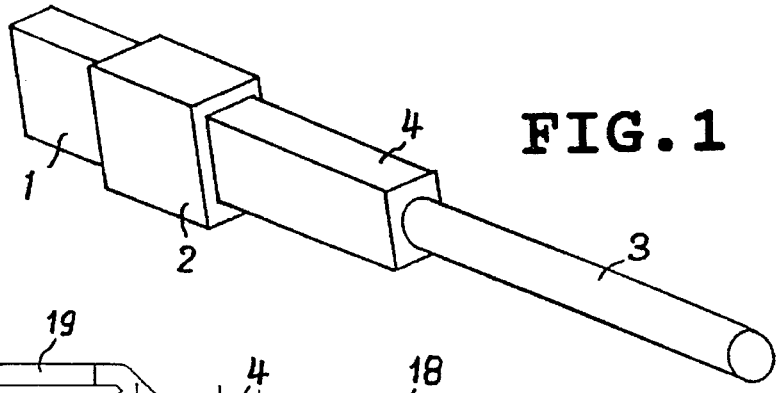
FIG. 1 is a diagrammatical schematic representation of an anti-kink apparatus in a plug with a cable connection.
Figure 2:
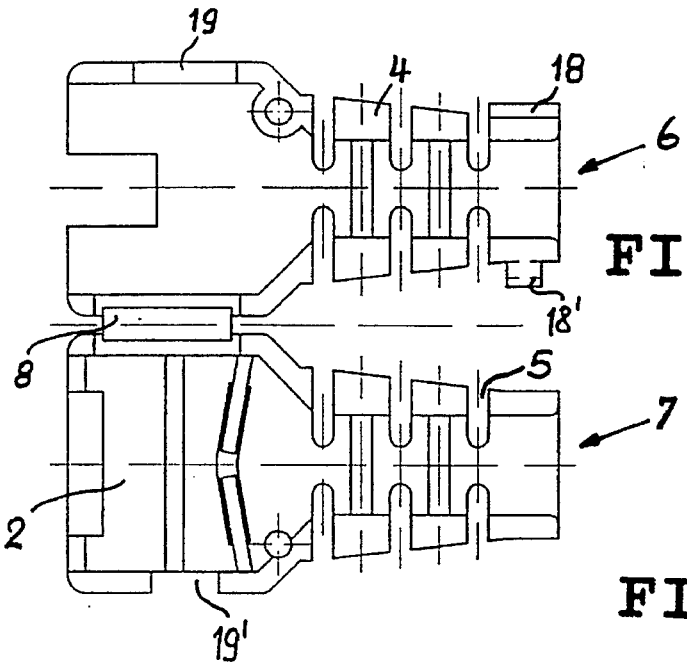
FIG. 2 is a top view of an embodiment of an anti-kink apparatus in accordance with the invention in the opened position.
Figure 3:
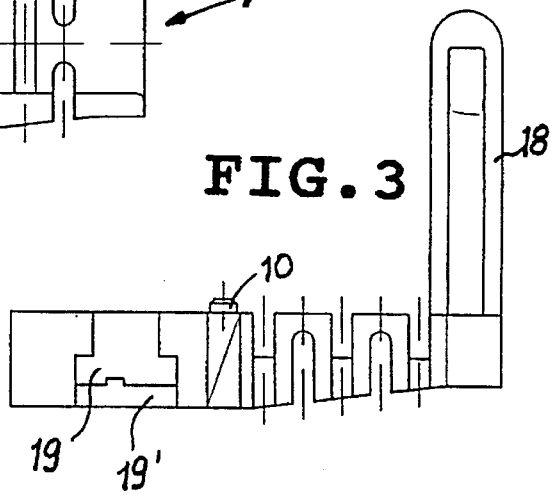
FIG. 3 is the arrangement in accordance with FIG. 2 in a side view.
Figure 4:
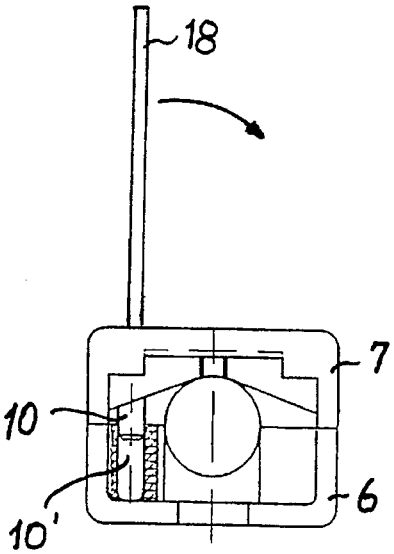
FIG. 4 is a front elevational view of the embodiment of FIG. 2 in a closed position as seen from the plug side.
Figure 5:
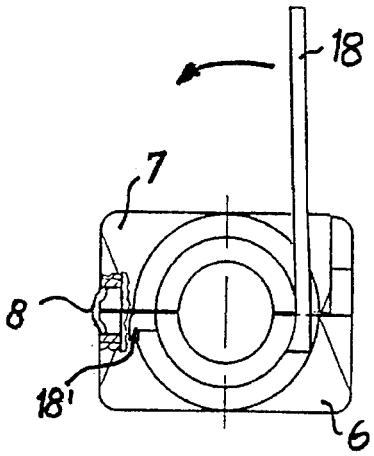
FIG. 5 is a front elevational view of the embodiment of FIG. 2 in a closed position as seen from the cable side.

The anti-kink device in accordance with FIG. 1 comprises of an articulated housing including a casing 2 and an element 4 which tapers in the direction of the cable and is elastically bendable by means of recesses 5 in the material thereof (FIG. 2). The casing 2 of the housing surrounds a plug 1, whereas the tapering element 4 of the housing surrounds a cable 3 extending from the plug 1.

The known anti-kink apparatus preferably consists of a synthetic material.

The anti-kink apparatus is preferably used in screened AMP plugs and DDKRJ45 plugs 1.

In accordance with the invention, the casing 2 and the element 4, as is shown in FIGS. 2 to 5, are integral components forming the articulated housing which is composed of two half shells 6, 7 connected via a film hinge 8 so as to allow opening and closing of the half shells 6, 7 with respect to one another, which provides a destruction-free exchange at will.

The closed half shells 6, 7 can be locked by loosenable bracket means. Said bracket (strap) means comprise a strap 18 which is molded on on the half shell 6. The strap 18 is guided around the half shell 7 when the half shells 6, 7 are closed and is hooked into a barb 18' mounted on the half shells. Furthermore, a T-tongue 19 is molded on at the plug-side end of the shell 6 which tongue engages below a countergroove 19' of the shell 7 in the closed condition.

Furthermore, a centering pin 10 is provided on one of the half shells 6 or 7, which pin engages in a counterbore 10' in the other half shell when the housing 6, 7 is closed.

The anti-kink apparatus in accordance with the invention may be provided in any colour, whereby the flat arrangement of casing element 2 in particular allows the attachment of labels.

It is to be understood that the invention is not limited to the described embodiment but may be embodied and practised within the scope of the following claims.

What I claim is:

1. An anti-kink apparatus for closely surrounding a plug-and-cable assembly, comprising (a) a housing formed of first and second complemental half shells;

(b) connecting means for articulating the half shells to one another whereby said half shells are pivotal with respect to one another; said half shells have a closed position for entirely closely surrounding the plug-and-cable assembly and an open position in which said half shells are removable from or placeable on the plug-and-cable assembly; and (c) releasable locking means having a locked position for maintaining said half shells locked in the closed position thereof and an unlocked position for allowing said half shells to be pivoted from the closed position into the open position thereof, whereby the half shells are replaceable and reusable, said releasable locking means comprising:

(i) a strap having first and second ends; said first end being affixed to said first half shell; and (ii) a barb affixed to one of said half shells; in said locked position said strap closely surrounds a circumferential portion of said second half shell and said second end of said strap is hooked into said barb; said second end of said strap being releasable from said barb for placing said releasable locking means into said unlocking position.

2. The anti-kink apparatus as defined in claim 1, wherein the apparatus is of a synthetic material.

3. The anti-kink apparatus as defined in claim 1, wherein said connecting means comprises a film hinge.

4. The anti-kink apparatus as defined in claim 1, wherein said barb is affixed to said first half shell.

5. The anti-kink apparatus as defined in claim 1, wherein said first end of said strap is molded on said first half shell.

* * * * *